US005300913A

United States Patent [19]

Linton

[11] Patent Number: 5,300,913

[45] Date of Patent: Apr. 5, 1994

[54] CONTACT SPRING CLIP FOR A CARTRIDGE FUSE BLOWN FUSE LIGHT INDICATOR

[75] Inventor: John C. Linton, Potomac, Md.

[73] Assignee: FIC Corporation, Rockville, Md.

[21] Appl. No.: 63,305

[22] Filed: May 18, 1993

[51] Int. Cl.[5] ..... H01H 85/32

[52] U.S. Cl. ..... 337/242; 337/241; 337/245

[58] Field of Search ..... 337/241, 242, 245, 213, 337/214, 215, 186, 187, 191, 193, 195, 206, 207, 208, 209; 439/621, 622

[56] References Cited

U.S. PATENT DOCUMENTS 2,225,912 12/1940 La Mar ..... 337/242

2,276,785 3/1942 La Mar ..... 337/242

3,432,789 3/1969 Poehlman ..... 337/242

3,457,535 7/1969 Poehlman ..... 337/242

*Primary Examiner*—Harold Broome

*Attorney, Agent, or Firm*—Brady, O'Boyle & Gates

[57] ABSTRACT

A contact spring clip for a cartridge fuse blown fuse light indicator wherein the spring clip is manually squeezable for the installation and removal of the clip on the barrel of a cartridge fuse. The spring clip is provided with a track for holding an electrical contact assembly connected to the ferrules of the cartridge and which can either be connected to a blown fuse light indicator positioned at a location remote from the fuse, or connected to a blown fuse light indicator mounted on the electrical contact assembly.

9 Claims, 2 Drawing Sheets

FIG. 1
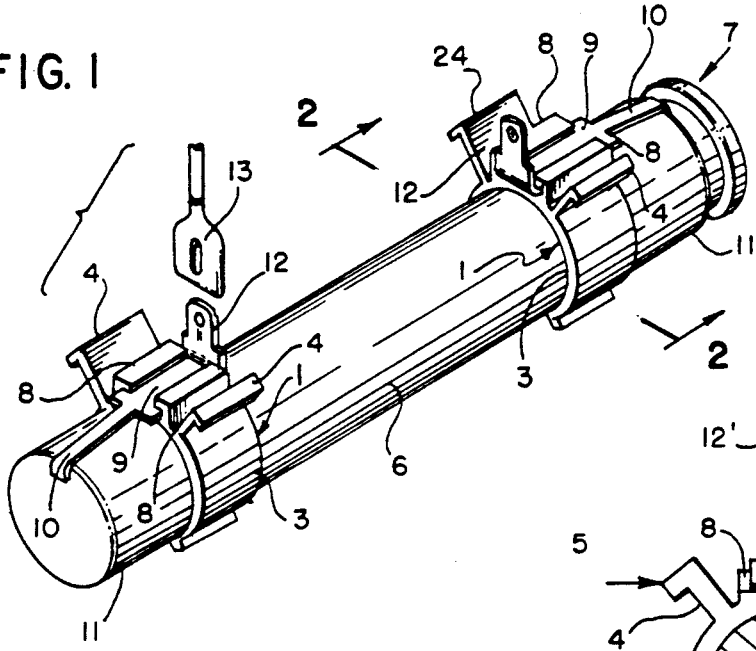
FIG. 2
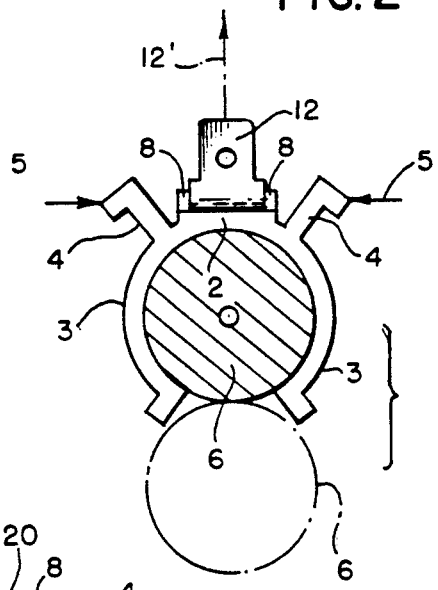
FIG. 4
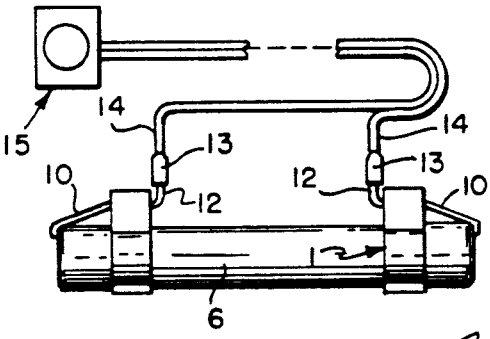
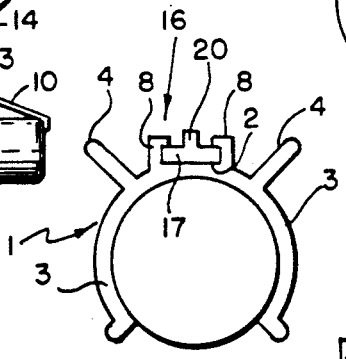
FIG. 7
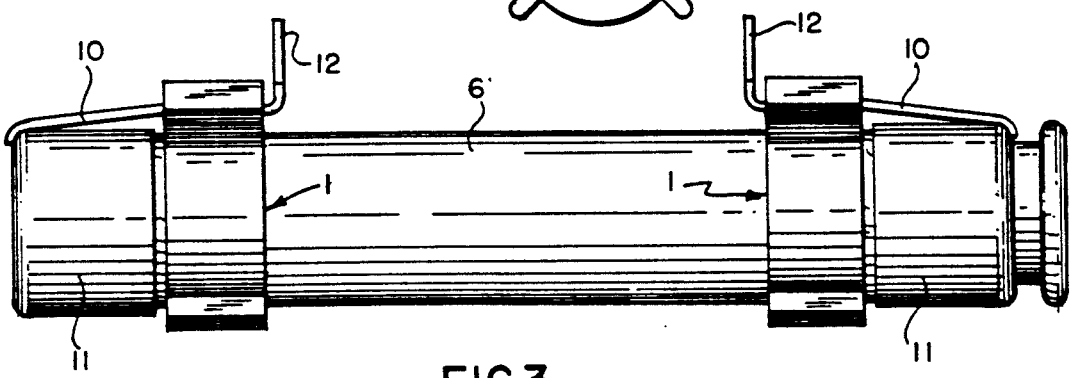
FIG. 3

FIG. 5
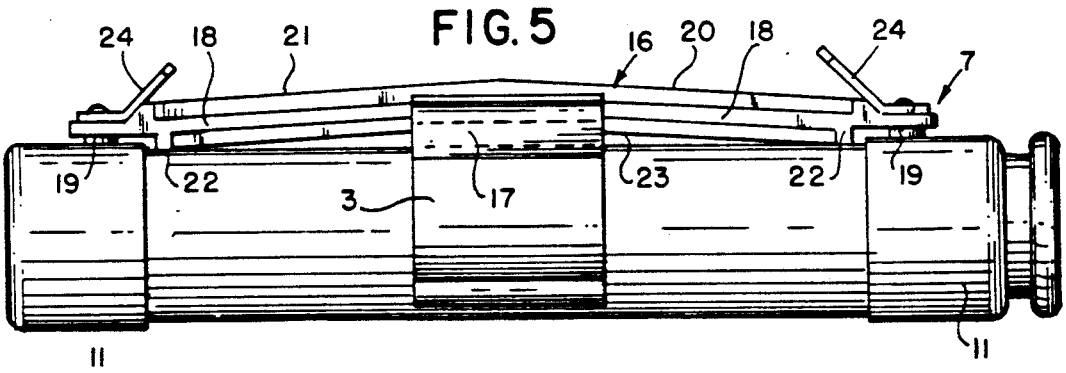
FIG. 6
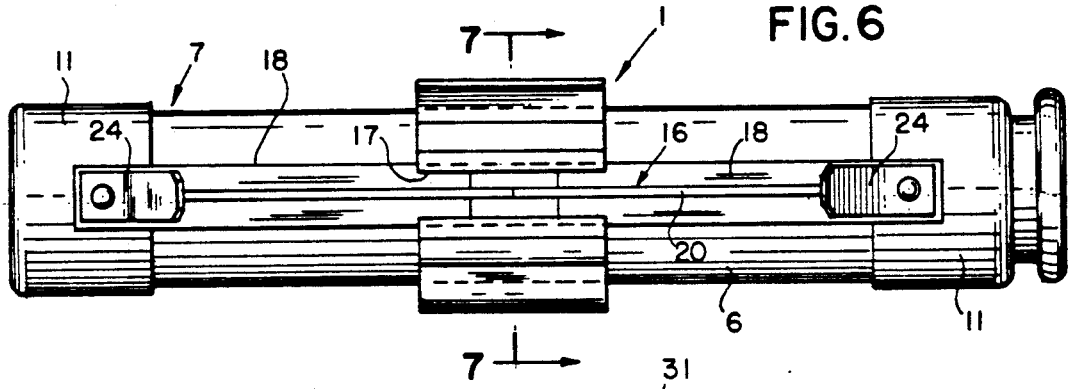
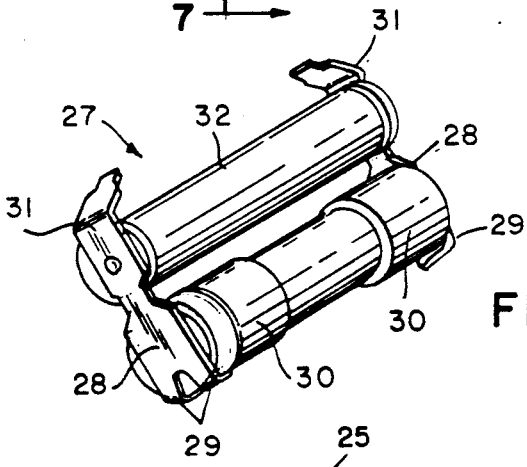
FIG. 9
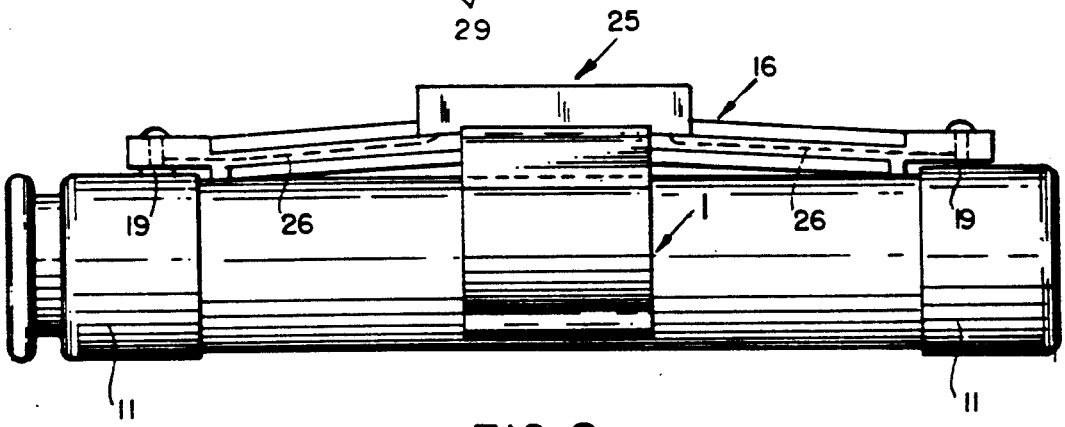
FIG. 8

CONTACT SPRING CLIP FOR A CARTRIDGE FUSE BLOWN FUSE LIGHT INDICATOR

BACKGROUND OF THE INVENTION

Various spring clips have been provided for securing a blown fuse light indicator to a cartridge fuse as evidenced by U.S. Pat. Nos. 3,432,789 dated Mar. 11, 1969, and 3,457,535 dated Jul. 22, 1969. These types of clips are characterized by the blown fuse light indicator being integrally connected to the clip which is either snapped onto the ferrules of the fuse, or onto the fuse barrel with the light indicator being connected to the fuse contacts by "pigtail" conductors.

While these clips have been satisfactory for their intended purpose, they have been restricted for use on predetermined sized fuse cartridges. The conductors have been integrally connected between the light indicator and the fuse contacts, thus precluding the positioning of the light indicator at a remote location from the cartridge fuse.

SUMMARY OF THE INVENTION

After considerable research and experimentation, the spring clip of the present invention has been devised to snap onto the barrel of a fuse cartridge, the clip carrying a contact engaging the ferrule of a cartridge fuse and connected to the end of a conductor electrically connected to a blown fuse light indicator positioned at a location remote from the fuse.

In another embodiment, the spring clip is constructed and arranged to carry a bridge member extending axially of the fuse and having the blown fuse light indicator mounted thereon.

BRIEF DESCRIPTION OF THE DRAWINGS

FIG. 1 is a perspective view of a pair of spring clips of the present invention mounted on a cartridge fuse barrel, each clip carrying a contact engaging a respective ferrule of the fuse cartridge;

FIG. 2 is a view taken along line 2—2 of FIG. 1;

FIG. 3 is a side elevational view of the spring clips and associated contacts mounted on the cartridge fuse of FIG. 1;

FIG. 4 is a diagrammatic view of the spring clip contacts being connected to a blown fuse light indicator positioned at a location remote from the fuse;

FIG. 5 is a side elevational view of another embodiment of the invention wherein a single clip is mounted on the fuse barrel and carrying a bridge member having contacts at opposite ends thereof for connection to a remote blown fuse light indicator, as shown in FIG. 4;

FIG. 6 is a top plan view of the embodiment shown in FIG. 5;

FIG. 7 is a view taken along line 7—7 of FIG. 6; and

FIG. 8 is a side elevational view of a further embodiment wherein the bridge member shown in FIG. 5 carries the blown fuse indicator light rather than being remote therefrom; and FIG. 9 is a perspective view of yet another embodiment of the invention wherein a pair of fuse spring clips are connected by an insulated handle.

DESCRIPTION OF THE PREFERRED EMBODIMENT

Referring to the drawings and more particularly to FIGS. 1 and 2, the contact spring clip 1 of the present invention comprises a resilient plastic member having a planar base portion 2 and depending integral arcuate leg portions 3. Outwardly extending arm members 4 are integrally connected to the upper end portions of the leg portions 3 adjacent the base portion 2, whereby the arm members 4 can be squeezed in the direction of the arrows 5, shown in FIG. 2, to thereby spread the leg portions 3 to facilitate the installation or removal of the clip on the barrel 6 of a cartridge fuse 7. The base portion 2 of the clip is provided with upwardly spaced, inwardly extending flange members 8 to thereby form a groove or track for receiving the base portion 9 of a contact having one terminal end 10 engaging the ferrule 11 of the fuse and another terminal end 12 adapted to be connected to a spade terminal 13 connected to the end of an electrical conductor 14 connected to a blown fuse light indicator 15, FIG. 4, positioned in a location remote from the fuse 7.

To mount the contact on the clip, the terminal end 12 is initially in the same horizontal plane coextensive with the base portion 9, whereby the contact can be slidably mounted axially into the track provided by the flanges 8, after which, the terminal end 12 is bent upwardly as indicated by the arrow 12' in FIG. 2.

As will be understood by those skilled in the art, the blown fuse light indicator 15 is of the type disclosed in the aforementioned patents, and includes a neon lamp and a current limiting resistor connected in series, and the remote location at which the light indicator is positioned can be the exterior surface of the door of the fuse box in which the fuse is housed, or on a control panel more remote from the fuse box.

While the embodiment shown in FIGS. 1 to 4 employs a pair of clips 1, whereby the contact assembly is adapted to be mounted on cartridge fuses of various lengths, FIGS. 5 to 7 illustrate another embodiment wherein a single clip 1 is employed. In this arrangement, a bridge member 16 is mounted in the groove provided by the flange members 8, and is formed with a medial crown portion, 17 having integral downwardly and axially extending leg portions 18 terminating in contact members 19 engaging the ferrules 11 of the fuse cartridge 7. A reinforcing rib 20 is integral with the top surfaces of the medial portion 17 and leg portions 18, and a corresponding reinforcing rib 21 is integral with the bottom surfaces of the medial portion 17 and leg portions 18. Each end of the lower reinforcing rib is provided with an integral foot member 22 engaging the barrel 6 of the fuse, while the medial portion of the bridge is spaced as at 23 from the barrel 6 of the fuse. By this construction and arrangement, the contact members 19 are biased downwardly in electrical contact with the fuse ferrules 11.

As in the embodiment of FIG. 4, the contact members 19 are provided with a contact portion or tab 24 adapted to be connected to the spade terminals 13 for connection to the remote light indicator 15.

While the clip 1 and bridge assembly 16 of FIGS. 5 to 7 are employed for connecting the contacts 19 to a cartridge fuse 7 having a remote light indicator, FIG. 8 shows a further embodiment wherein the clip 1 and bridge 16 are employed for mounting the blown fuse light indicator 25 on the barrel 6 of the fuse. In this embodiment, the light 25 is mounted on the medial crown portion of the bridge 16 and electrical conductors 26 extend from the light 25 and are connected to the contacts 19.

FIG. 9 illustrates yet another embodiment of the invention wherein the clip 27 comprises a contact 28 having an inwardly bent bifurcated terminal end 29 engaging the fuse ferrules 30, and another terminal end 31 adapted to be connected to a spade terminal connected to a remote blown fuse light indicator as shown in FIG. 4. An insulated handle 32 extends between the terminal ends 31 and connected thereto, whereby the spring clip 27 can be handled as a unit when being mounted on or removed from the fuse.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A contact spring clip for a blown fuse light indicator for a cartridge fuse having a barrel and a ferrule at each end thereof, comprising, a resilient member having a planar base portion, depending arcuate leg portions having upper end portions integral with the base portion adapted to be snapped onto the barrel of the cartridge fuse, outwardly extending arm members integral with the upper end portions of the leg portions adjacent the base portion, said arm members being manually squeezable to thereby spread the leg portions to facilitate the installation and removal of the clip on the barrel of the cartridge fuse, inwardly extending flange members integral with and upwardly spaced from the base portion forming a track on the base portion of said clip, electrical contact means mounted in said track, a blown fuse light indicator, and electrical conductor means operatively connected between the electrical contact means and the blown fuse light indicator.

2. A contact spring clip according to claim 1, wherein the electrical contact means comprises, a base portion mounted in said track on said clip, one terminal end extending axially from said base portion and engaging a ferrule of the cartridge fuse, another terminal end extending axially from said base portion and adapted to be connected to the conductor means.

3. A contact spring clip according to claim 2, wherein a clip and associated electrical contact means are mounted on the cartridge fuse barrel at each end thereof.

4. A contact spring clip according to claim 3, wherein the blown fuse light indicator is positioned at a location remote from the cartridge fuse, said conductor means extending from the electrical contact means to the blown fuse light indicator.

5. A contact spring clip according to claim 1, wherein the electrical contact means comprises a bridge member extending axially of the fuse and mounted in the clip track, said bridge member having a top surface, a bottom surface and a medial crown portion positioned in said track and integral downwardly and axially extending leg portions, a contact member connected to the free end portion of each leg portion and engaging a respective ferrule on the end of the fuse cartridge, and a tab connected to each contact member adapted to be connected to the conductor means.

6. A contact spring clip according to claim 5, wherein the blown fuse light indicator is positioned at a location remote from the cartridge fuse, said conductor means extending from the tabs to the blown fuse light indicator.

7. A contact spring clip according to claim 5, wherein a reinforcing rib is integral with the top surface of the medial crown portion and leg portions of the bridge member, a corresponding lower reinforcing rib integral with the bottom surface of the medial crown portion and leg portions of the bridge member, a foot member integrally connected to the lower reinforcing rib at each end thereof, said foot members engaging the barrel of the fuse, the medial portion of the bridge member being spaced above the fuse barrel, whereby the contact members are biased downwardly in electrical contact with the fuse ferrules.

8. A contact spring clip according to claim 1, wherein the electrical contact means comprises a bridge member extending axially of the cartridge fuse and mounted in the clip track, said bridge member having a medial crown portion positioned in said track and integral downwardly and axially extending leg portions, a contact member connected to an end portion of each leg portion and engaging a respective ferrule on the end of the fuse cartridge, the blown fuse light indicator being mounted on the medial crown portion of the bridge member, the conductor means extending between the blown fuse light indicator and the contact members.

9. A contact spring clip for a cartridge fuse blown fuse light indicator comprising, a cartridge fuse having ferrules at each end thereof, a contact connected to the ferrule at each end of said cartridge fuse, each contact having a pair of terminal ends, one terminal end being bifurcated and engaging a respective fuse ferrule, the other terminal end connected to a spade terminal of a remote blown fuse light indicator, and an insulated handle extending between and connected to the contacts at each end of said fuse, whereby the spring clip can be handled as a unit when being removed from or applied to the cartridge fuse.

* * * * *